United States Patent [19]

Smits-Geurts

[11] 3,981,420

[45] Sept. 21, 1976

[54] PULL MEANS FOR SLIDABLE MEMBER FOR DOSING DEVICE

[76] Inventor: Louisa Josephina Smits-Geurts, Dorpstraat 48, Borkel en Schaft, Netherlands

[22] Filed: Jan. 20, 1975

[21] Appl. No.: 542,368

[52] U.S. Cl. ..... 222/505

[51] Int. Cl.[2] ..... B67D 3/00

[58] Field of Search ..... 222/559, 560, 561, 505; 251/294

[56] References Cited

UNITED STATES PATENTS

| | | | |
|---|---|---|---|
| 771,918 | 10/1904 | Munn | 222/505 |
| 788,015 | 4/1905 | Bergman | 222/505 |

*Primary Examiner*—Stanley H. Tollberg
*Attorney, Agent, or Firm*—Paul M. Denk

[57] ABSTRACT

A slidable member used in conjunction with a dosing device for dispensing a select quantity of granular material, a rope turns around a pulley connected to the supporting frame of the device, with two sections of said rope then extending parallel from the device, with one of the rope sections adjustably securing to a plate that connects with the slidable member.

6 Claims, 5 Drawing Figures

PULL MEANS FOR SLIDABLE MEMBER FOR DOSING DEVICE

The invention relates to a slidable member, more particularly a slide for use in a dosing device for dosing granular or powdery material, which slide is adapted to reciprocate with respect to a frame part supporting said slide. The invention also relates to a dosing device including such a slide.

In known constructions of the kind set forth the slides are displaced in a first direction with the aid of a rope, on which a pulling force is exerted, whereas the slide can be displaced in the opposite direction under the action of springs, when the rope is released. In practice it has been found that is some cases small quantities of the material to be dosed may get in between the slide and the frame or the like so that the slide may be jammed and the springs can no longer exert a sufficient force to return the slide into its initial position. The invention has for its object to provide a simple construction by means of which a force can be exerted on the slide in both directions.

According to the invention this can be achieved by securing a rope guide member to the frame part, whilst at least one of the rope sections extending at least substantially parallel to one another away from said guide member is fastened to a support secured to the slide so that the slide can be displaced both in one direction and in the other by pulling the rope. Thus a tractive force can be exerted on the two sections of the rope for moving the slide in one direction or in the other. The invention further provides a dosing device incorporating the above features.

The invention will now be described more fully with reference to an embodiment of the construction in accordance with the invention illustrated in the accompanying figures.

Figure 1:
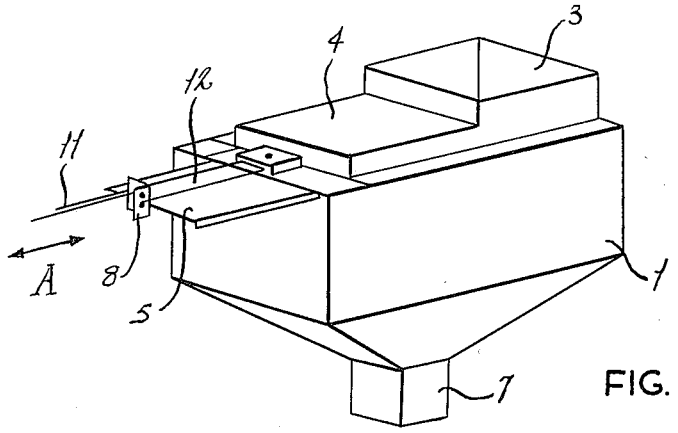
FIG. 1 is a schematic, perspective view of a dosing device comprising a slide in accordance with the invention.
Figure 2:
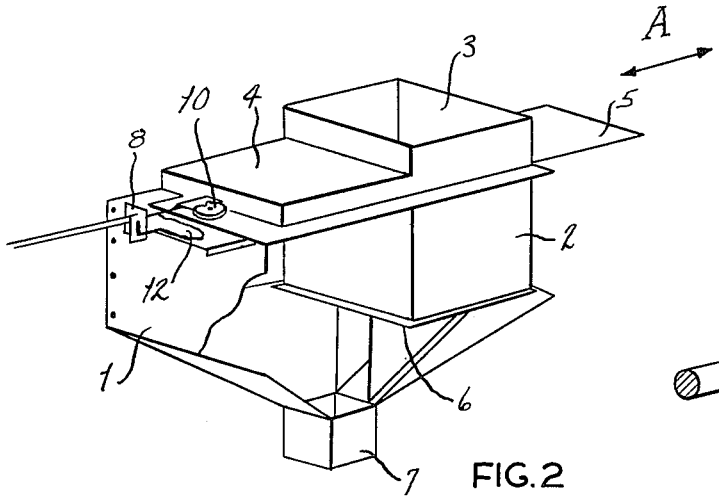
FIG. 2 shows the dosing device of FIG. 1, the slide occupying a different position, whilst some wall portions of the dosing device are omitted.
Figure 3:
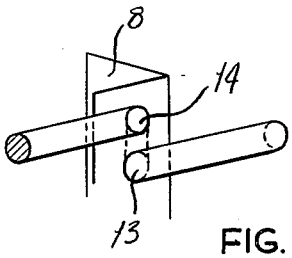
FIG. 3 is an enlarged, perspective view of a support with a rope passed through it.
Figure 4:
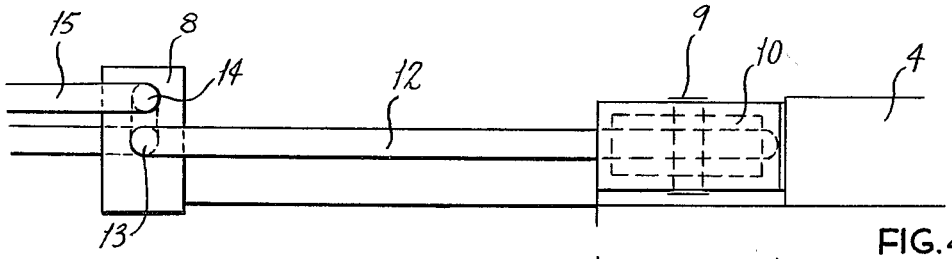
FIG. 4 is an enlarged view of the support and the guide member for the rope.
Figure 5:
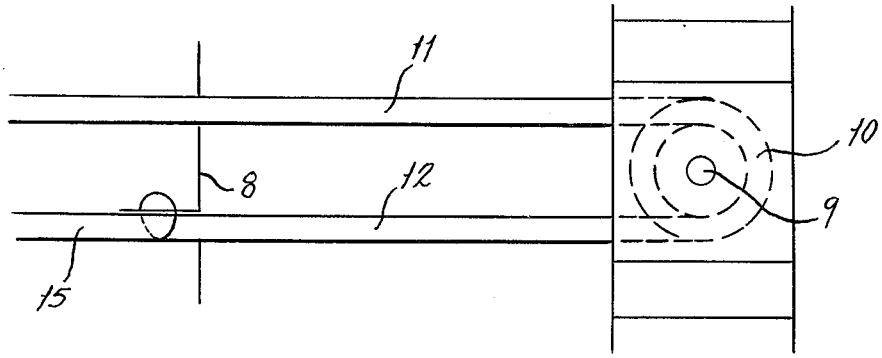
FIG. 5 is a plan view of the parts of FIG. 4.

A dosing device according to the invention shown in FIGS. 1 and 2, comprises a housing 1 in which a chamber 2 is mounted. Above the housing a cover 4 having an opening 3 is arranged and a slide 5 is adapted to reciprocate between the cover 4 and the housing 1 in the direction of the double arrow A. The slide 5 has an opening (not shown) so that in the position of the slide shown in FIG. 1 material from a stock silo or the like can flow into the chamber 2 through the passage 3 and the opening in the slide 5.

A closing member arranged in the housing 1 is adapted to slide to and fro with the slide 5 in a manner not shown and in the position of the slide 5 shown in FIG. 1 it shuts off the bottom side of the chamber 2, whereas in the position shown in FIG. 2 an open passage is formed on the bottom side of the cylinder 2 for the delivery of material through the delivery pipe 7 fastened to the housing.

To the slide is secured an angle-section iron 8 so that one limb thereof extends parallel to the direction of displacement of the slide 5, whereas the other limb of the angle-section iron extends along one edge of the slide, to which it is fastened. The cover 4 has furthermore fastened to it a guide member formed by a pulley 10, adapted to rotate about a vertical shaft 9. A rope is passed around the pulley, a first section of which rope 11 extends freely to an area, where the corresponding rope end is readily accessible for the hand to actuate the dosing device. The other rope section comprises a first portion 12, extending parallel to the section 11 between the pulley 10 and the limb of the angle-section iron 8 extending parallel to the direction of displacement of the slide 5. This limb of the angle-section iron has two openings 13 and 14 lying one vertically above the other, through which the second section of the rope is passed so that the remaining portion 15 of said section again extends parallel to the section 11, the free end of the portin 15 being located near the free end of the section 11 so that also this end lies within easy reach of the slide operator. If desired, the two ends may be connected with one another.

When a tractive force is exerted on the section 11, the slide 5 is displaced out of the position shown in FIG. 1 into the position shown in FIG. 2 and when subsequently the portion 15 of the second section is pulled, the slide 5 will shift back from the position illustrated in FIG. 2 to the position shown in FIG. 1. The link between the second section 12, 15 of the rope and the support 8 is such that at the exertion of a tractive force on the rope the later will not shift in place with respect to the support 8. It has been found that in order to establish an effective connection between the support 8 and the rope the distance between the centres of the holes 13 and 14 has to be preferably equal to twice the diameter of the rope.

If desired, springs may be provided to contribute to the displacement of the slide 5 in one of the two directions.

It will be obvious that by using the construction described above a robust connection between the rope and a slidable member can be obtained so that with the aid of a single rope the slidable member can be displaced in two opposite directions.

By the present invention an improved slidable member and a dosing device incorporating such a slidable member are provided.

I claim:

1. A slidable member for use in conjunction with the supporting frame of a dosing device for dispensing a select quantity of granular material, said slidable member being adapted for reciprocal movement in opposing directions with respect to the supporting frame of the dosing device, the improvement which comprises a rope means, pulley means connecting with said supporting frame and having a rope means arranged thereon, said rope means as arranged upon the pulley means forming a pair of rope sections that extend substantially parallel to each other and away from the supporting frame, a plate means secured to the said slidable member, there being a pair of holes provided in said plate means, one of said rope sections being arranged through said pair of holes to adjustably secure the rope means thereto, whereby upon a pull of one of the rope sections the said plate means and slidable member will be displaced in one of the opposing directions.

2. The invention of claim 1 wherein the space between the pair of holes provided through the plate means being approximately equivalent to the diameter of said rope means.

3. The invention of claim 2 wherein the pair of holes provided through the plate means are vertically arranged.

4. The invention of claim 1 wherein said pulley means includes a central pivot pin, a pulley provided for turning around said pin, and said pin being vertically arranged.

5. The invention of claim 2 wherein the distance between the center of said pair of holes is approximately twice the diameter of the rope means.

6. The invention of claim 1 wherein the diameter of each hole means being substantially equivalent to the diameter of said rope means.

* * * * *